US007992352B2

(12) United States Patent
Bonds et al.

(10) Patent No.: US 7,992,352 B2
(45) Date of Patent: Aug. 9, 2011

(54) MODULAR BUILDING FRAME

(76) Inventors: Delton J. Bonds, Bellevue, WA (US); Eric P. Bramwell, Woodinville, WA (US)

( * ) Notice: Subject to any disclaimer, the term of this patent is extended or adjusted under 35 U.S.C. 154(b) by 1775 days.

(21) Appl. No.: 10/267,112

(22) Filed: Oct. 7, 2002

(65) Prior Publication Data

US 2003/0024174 A1 Feb. 6, 2003

Related U.S. Application Data

(62) Division of application No. 09/468,981, filed on Dec. 21, 1999, now Pat. No. 6,460,297.

(51) Int. Cl.
*E04H 1/00* (2006.01)

(52) U.S. Cl. ..... 52/79.1; 52/91.2; 52/92.1; 52/92.3; 52/712; 52/293.3

(58) Field of Classification Search ..... 52/351, 52/299, 298, 261, 266, 481.1, 236.7, 236.9, 52/79.1, 91.2, 90.1, 263.3, 234, 293.3, 638, 52/656.9, 90.2, 91.3, 92.1, 92.3, 238.1, 633, 52/691, 698, 202, 712, 282.4, 281, 656.1
See application file for complete search history.

(56) References Cited

U.S. PATENT DOCUMENTS

| | | | | | |
|---|---|---|---|---|---|
| 1,819,970 | A | * | 8/1931 | Peden | 52/92.2 |
| 1,983,020 | A | * | 12/1934 | Vol | 52/238.1 |
| 2,067,403 | A | * | 1/1937 | Lea | 52/745 |
| 2,076,728 | A | * | 4/1937 | Keller | 52/238.1 |
| 2,104,500 | A | * | 1/1938 | Van Buren | 52/220.1 |
| 2,104,869 | A | * | 1/1938 | Levy | 52/274 |
| 2,104,870 | A | * | 1/1938 | Levy | 52/264 |
| 2,111,634 | A | * | 3/1938 | Ktrbaty | 403/21 |
| 2,574,074 | A | * | 11/1951 | Vogel | 52/377 |
| 2,990,590 | A | * | 7/1961 | Graveley | 403/189 |
| 3,279,132 | A | * | 10/1966 | Slayter | 52/73 |
| 3,449,877 | A | * | 6/1969 | Beckman | 52/243.1 |
| 3,657,849 | A | * | 4/1972 | Garton | 52/91.1 |
| 3,702,044 | A | * | 11/1972 | Balinski | 52/30 |
| 3,774,362 | A | * | 11/1973 | Matuschek et al. | 52/206 |
| 4,088,229 | A | * | 5/1978 | Jacoby et al. | 211/191 |
| 4,130,970 | A | * | 12/1978 | Cable | 52/236.3 |
| 4,198,175 | A | * | 4/1980 | Knepp et al. | 403/191 |
| 4,230,416 | A | * | 10/1980 | Gilb | 403/232.1 |
| 4,350,318 | A | * | 9/1982 | Gallis | 249/40 |

(Continued)

FOREIGN PATENT DOCUMENTS

| | | | | |
|---|---|---|---|---|
| FR | 992318 | * | 10/1951 | 52/274 |

(Continued)

*Primary Examiner* — Phi D. A
(74) *Attorney, Agent, or Firm* — J. Michael Neary

(57) ABSTRACT

A building frame resistant to earthquakes, gale-force wind loads, fire, insects and rot includes a peripheral frame wall constructed of rectangular steel tubing. Side wall frame modules and end wall modules bolted together along adjacent edges form the peripheral frame wall. Diagonal bracing is built into selected side and end wall modules as required for the desired degree of wind resistance. Trusses made of various size tube such as 2×3 inch rectangular steel tubing for supporting a roof, including a hip roof, on the peripheral wall, are assembled and welded in a welding shop and the prefabricated trusses and wall modules are trucked to the building site. Multiple stories may be erected and fastened together by anchor brackets arranged bottom-to-bottom above and below the second and higher floors. The building frame is secured to a foundation by attaching the anchor brackets to anchor bolts set in the foundation.

7 Claims, 15 Drawing Sheets

U.S. PATENT DOCUMENTS 4,480,941 A * 11/1984 Gilb et al. ..... 403/232.1
4,498,801 A * 2/1985 Gilb ..... 403/232.1
4,501,103 A * 2/1985 Markey et al. ..... 52/745
4,570,402 A * 2/1986 Johnson ..... 52/241
5,042,217 A * 8/1991 Bugbee et al. ..... 52/643
5,092,097 A * 3/1992 Young ..... 52/702
5,109,646 A * 5/1992 Colonias et al. ..... 52/712
5,324,132 A * 6/1994 Hunter et al. ..... 403/232.1
5,333,426 A * 8/1994 Varoglu ..... 52/236.7
5,394,668 A * 3/1995 Lim ..... 52/483.1
5,524,400 A * 6/1996 Schmechel ..... 52/474
5,546,718 A * 8/1996 Way ..... 52/238.1
5,596,860 A * 1/1997 Hacker ..... 52/763
5,603,580 A * 2/1997 Leek et al. ..... 403/232.1
5,657,606 A * 8/1997 Ressel et al. ..... 52/690
5,678,382 A * 10/1997 Naito ..... 52/745.21
5,782,047 A * 7/1998 De Quesada ..... 52/236.6
5,946,867 A * 9/1999 Snider et al. ..... 52/167.1
5,970,677 A * 10/1999 Masters et al. ..... 52/712
6,092,340 A * 7/2000 Simmons ..... 52/92.1
6,158,184 A * 12/2000 Timmerman et al. ..... 52/293.3
6,209,268 B1 * 4/2001 Schmidt ..... 52/92.1
6,389,778 B1 * 5/2002 Strange ..... 52/745.19
6,443,411 B1 * 9/2002 Merriweather, Jr. ..... 248/300
6,523,321 B1 * 2/2003 Leek et al. ..... 52/702
6,786,017 B2 * 9/2004 Thompson ..... 52/298

FOREIGN PATENT DOCUMENTS

JP 49905 * 2/1994 ..... 52/79.1
JP 88409 * 3/1994 ..... 52/79.1

* cited by examiner

MODULAR BUILDING FRAME

This application is a division of U.S. patent application Ser. No. 09/468,981 filed on Dec. 21, 1999 and issued on Oct. 8, 2002 as U.S. Pat. No. 6,460,297, and also filed as PCT Application No. PCT/US00/35500 on Dec. 21, 2000 and published on Jun. 28, 2001 as Publication No. WO 01/46531.

This invention relates to improved modular frames for buildings and buildings constructed from such frames, and more particularly to high quality buildings that can be erected quickly and at low cost from tubular steel modular frame units that are fabricated off site and trucked to the building site where they are bolted together into a building frame by a small work crew without the use of heavy equipment.

BACKGROUND OF THE INVENTION

Conventional building practice for residence housing and small commercial buildings relies primarily on wood frame construction in which the building frame is constructed on site from framing lumber cut to fit piece-by-piece individually. It is a labor intensive process and demands considerable skill from the carpenters to produce a structure that has level floors, perfectly upright walls, square corners and parallel door and window openings. Even when the building frame is constructed with the requisite care and skill, it can become skewed by warping of the lumber, especially modern low grade lumber produced on tree farms with hybrid fast-growth trees.

Although conventional wood frame buildings require very little equipment for construction, they have become quite costly to build. The labor component of the cost is substantial, partly because of the wages that must be paid for the laborious process of constructing the frame, and partly because of the many government mandated extra costs such as workman's compensation and liability insurance, social security payments, medical insurance premiums, and the host of reports that must be made to the Government by employers. Accordingly, employers now seek to minimize their work force by whatever means is available to minimize these burdensome costs.

Steel frame construction, usually referred to as "red iron" construction, is commonly used on commercial buildings because of its greater strength, fire resistance and architectural design flexibility. The parts of such a steel frame are typically cut and drilled to order in accordance with the architect's plans, then trucked to the building site and assembled piece-by-piece with the use of a portable crane. The building can be made precisely and as strong as needed, but the cost is relatively high because of the costly materials and the skilled crew and expensive equipment need to assemble the building. It is a construction technique generally considered unsuitable for single family residence building because the cost is high and the building walls are substantially thicker than those made using standard frame construction, so standard door and window units do not fit properly and must be modified with special trim that rarely produces the desired aesthetic appearance.

Earthquake damage is becoming a matter of increasing concern among homeowners because of the publicity given to damage and loss of life in recent earthquakes in the U.S. and abroad. Earthquake preparedness stories and advice abound, but an underlying unresolved concern is that conventional wood frame homes in the past were not built to tolerate the effects of an earthquake, neither in its ultimate load-bearing capability nor its post-quake serviceability limits. Modern building codes attempt to address this concern, but the measures they require merely add to the already high cost of a new home and may not always provide significantly improved resistance to earthquake damage, particularly with respect to after-quake serviceability.

Fire often follows an earthquake, as happened in the disastrous Kobe earthquake of 1994, and of course fire is a major threat to homes independent of earthquake. When fire breaks out in a conventional home, the wood frame fuels the fire and reduces the chances of successfully extinguishing it before the entire structure is destroyed. The major life saving advance in the recent past is the fire alarm which detects the fire and alerts the occupants that a fire has started so they may escape before burning up with the house, but significant improvements to the fire resistance of the home itself that would retard the spread of the fire would be desirable.

The other major catastrophic threat to homes is wind. Wind loads on wood frame homes have destroyed many homes, primarily because the roof is usually attached so weakly to the walls that the combination of lift, exerted upward on the roof by the Bernoulli effect of the wind flowing over the roof, and pressure under the eves tending to lift the roof off the walls, wrenches the roof off the walls and allows the wind to carry the roof away like a big umbrella. Without the roof, the walls of the-house collapse readily under the wind load, completing the total destruction of the house.

Termite and carpenter ant damage to wood frame homes is a major form of damage, costing many millions of dollars per year. Although the damage done by insects is rarely life threatening, it is actually more extensive in total than the combined effects of wind and earthquake, and it is an ever-present danger in many parts of the country.

Thus, there has existed an increasing need for a home building frame design that would enable the inexpensive construction of homes that are highly tolerant of the effects of earthquakes, do not support combustion, are capable of withstanding high winds, are immune to damage from insects, and can use standard building components such as door and window units. Such a building frame concept would be even more commercially valuable if it were possible to erect the building in a short time with a small crew and without heavy equipment, and the frame could be adapted to produce buildings of attractive building styles desired locally. Such a building frame is disclosed in U.S. Pat. No. 6,003,280 issued to Orie Wells on Dec. 21, 1999 and assigned to the assignee of this application. However, numerous improvements were found to be desirable in the building frame system shown in that patent for improved design flexibility, fabrication economy, ease of assembly and improved structural strength and resistance to adverse environmental conditions.

SUMMARY OF THE INVENTION

Accordingly, this invention provides an improved building frame, ideally suited for single story and multi-story buildings, that can be assembled rapidly at the building site by bolting together metal frame modules fabricated off site and attaching sheet metal elements that simplify the finishing of the building with exterior sheathing and interior wall board. This invention also provides an improved metal frame for a building having integral internal diamond bracing that enables the building to withstand the racking of severe earthquakes and high winds yet be cost competitive with comparable wood frame buildings. This invention provides an improved process for constructing a building frame that uses low cost standard frame modules for the majority of the frame and shorter or lower versions of the standard modules to adjust the length or height of the frame walls to accommodate any desired building size and joist height for floors between stories, to produce a building frame that is cost competitive with conventional wood frame buildings and substantially more resistant to damage from wind, fire and earthquakes. A further object of this invention is to provide an improved steel frame building having walls the same thickness as conventional wood frame buildings, so that standard door and window units can be used with normal appearance, but the building has the strength of a steel frame building and superior fire resistant benefits, while remaining cost-competitive with conventional wood frame buildings. This invention also provides an improved steel building frame that can be erected quickly in multiple stories using standard frame and anchor brackets. The invention provides a roof frame system using rectangular steel tubing that can accommodate virtually all desired roof designs, including hips and gables.

These and other features of the invention are attained in a building frame having side walls made of side wall frame modules bolted together along adjacent edges and end walls made of end wall frame modules bolted together along adjacent edges. The frame modules are constructed of rectangular steel tubing, typically 2"×2", welded together in a welding jig to ensure exact 90° angles. The gauge or thickness of the tubing walls is selected for the desired strength. The wall frame modules, other than the window and door modules, have diagonal diamond bracing to provide rigidity against folding or wracking wind loads and forces experienced during earthquakes. The end walls are each bolted at their ends to ends of the side walls to form a peripheral wall of the building. Trusses for supporting a roof on the peripheral wall are bolted into pockets on top of the side walls between structural members at the top of the wall to secure the roof of the building on the peripheral wall, and structural tubing elements are connected diagonally to the trusses, coplanar with the top chords of those trusses, for supporting purlins adjacent the ridges of a hip roof. The peripheral wall is secured to a concrete foundation by attachment of the frame modules to special anchor brackets bolted to anchors set in a concrete foundation. The same anchor brackets can be arranged in pairs, oriented bottom-to-bottom, clamping between them the second story floor panels, to secure the frame wall of the second and subsequent stories to the supporting story below it and to establish high strength tensile load path between the foundation and the frame modules and the roof trusses. Light gauge metal elements are fastened on the inside and outside surfaces of the wall frame modules for speedy attachment of interior wall board and exterior siding. The roof is supported by longitudinally extending purlins that are attached to the trusses by the use of U-shaped brackets that are pre-welded to the top of the trusses. A canted eve strut is supported atop the side and/or end wall modules at the same angle as the top chord of the trusses to provide a flush support for the roof sheathing, parallel and in the same plane with the purlins. A high strength tensile load path is thus established through steel structure from the foundation through the frame to the roof for resisting high wing loading and shaking forces of earthquakes.

DESCRIPTION OF THE DRAWINGS

The invention and its many attendant objects and advantages will become better understood upon reading the following description of the preferred embodiment in conjunction with the following drawings, wherein.

DESCRIPTION OF THE PREFERRED EMBODIMENTS

Figure 1:
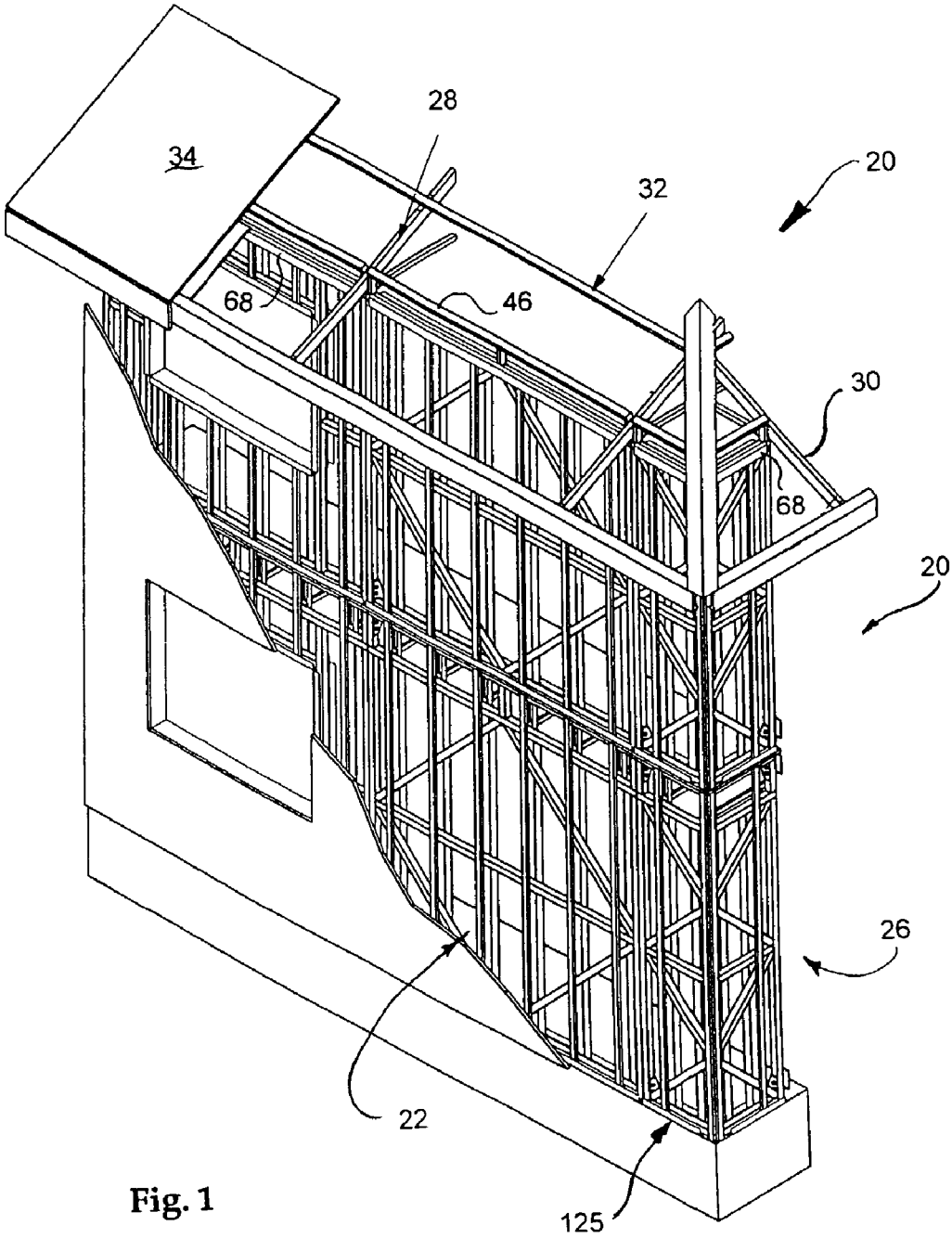
FIG. 1 is a perspective view of one end of a two-story building frame made in accordance with this invention.
Figure 2:
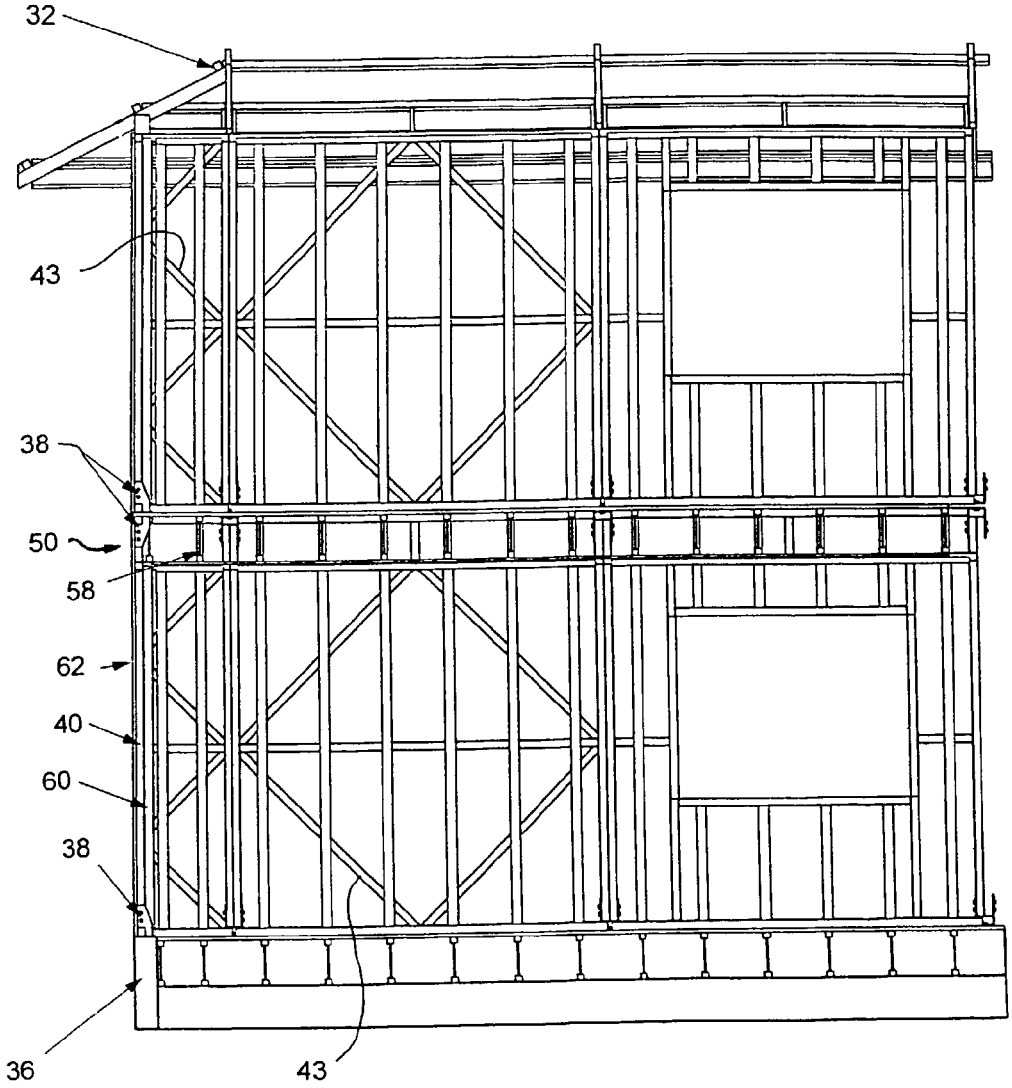
FIG. 2 is a cross sectional elevation from the inside of the building frame shown in FIG. 1.

Turning now to the drawings, wherein like reference numerals designate identical or corresponding parts, and more particularly to FIGS. 1 and 2 thereof, one end corner of a two-story building frame 20 is shown having a peripheral wall (shown only partially) supporting a roof truss structure. The peripheral wall is made of two end walls 22 (only one of which is shown in FIG. 1) connected at their ends to ends of two side walls 26 (a portion of only one of which is shown in FIG. 1). The upper portions of the side walls 26 support opposite ends, of a plurality of main trusses 28 spaced apart along the side walls at regular intervals, and the end walls 22 support one end of a plurality of hip roof jack trusses 30, the other ends of which are supported on the main trusses 28 as will be described in more detail below. A plurality of purlins 32 are attached to the trusses 28 and 30 for supporting roof sheathing 34. The peripheral wall may be secured to a building foundation 36 by anchor brackets 38 bolted to the foundation by anchor bolts or the like, described in detail below.

Figure 3:
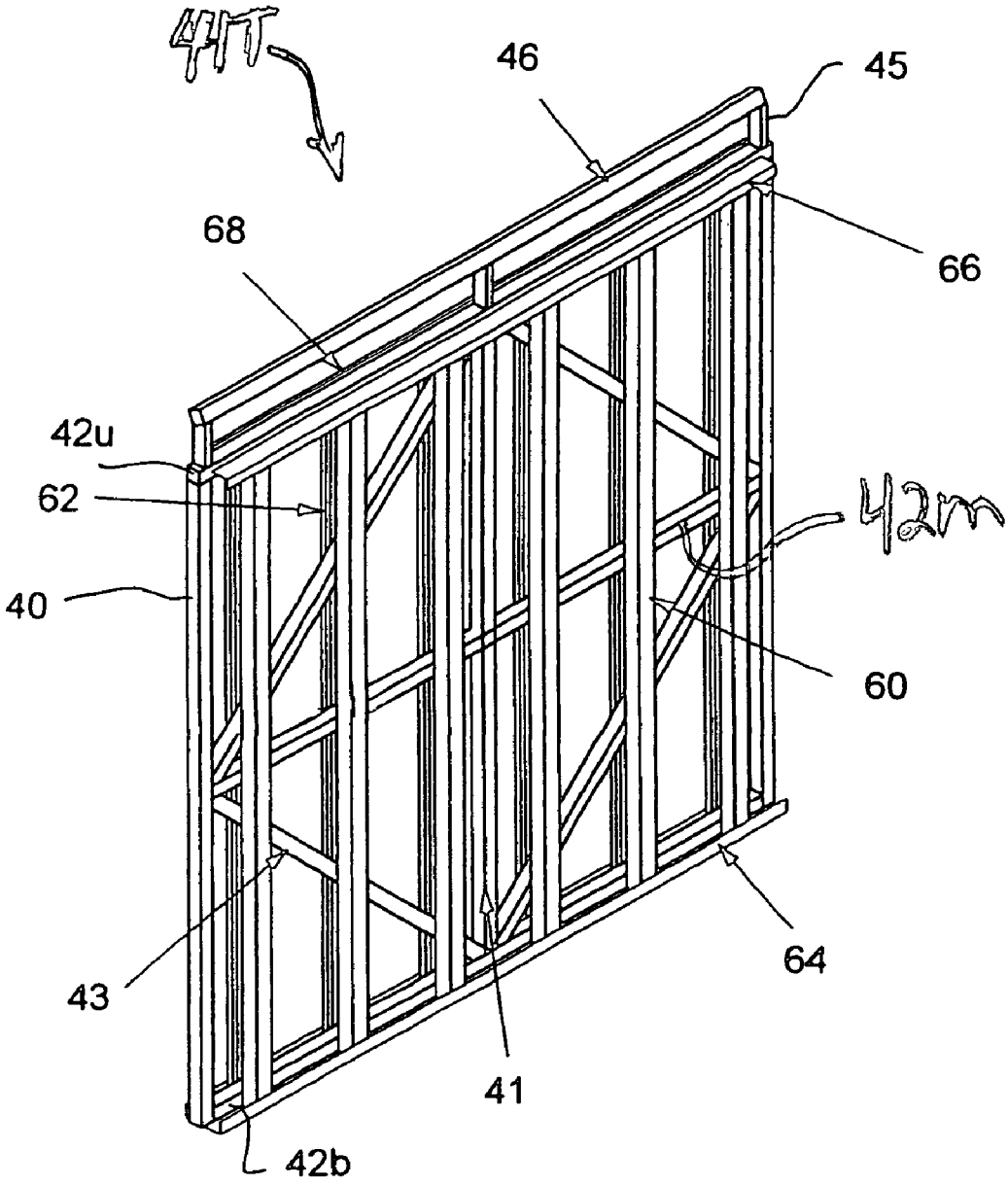
FIG. 3 is a perspective view of a top story building frame wall module for use in buildings made in accordance with this invention.
Figure 4:
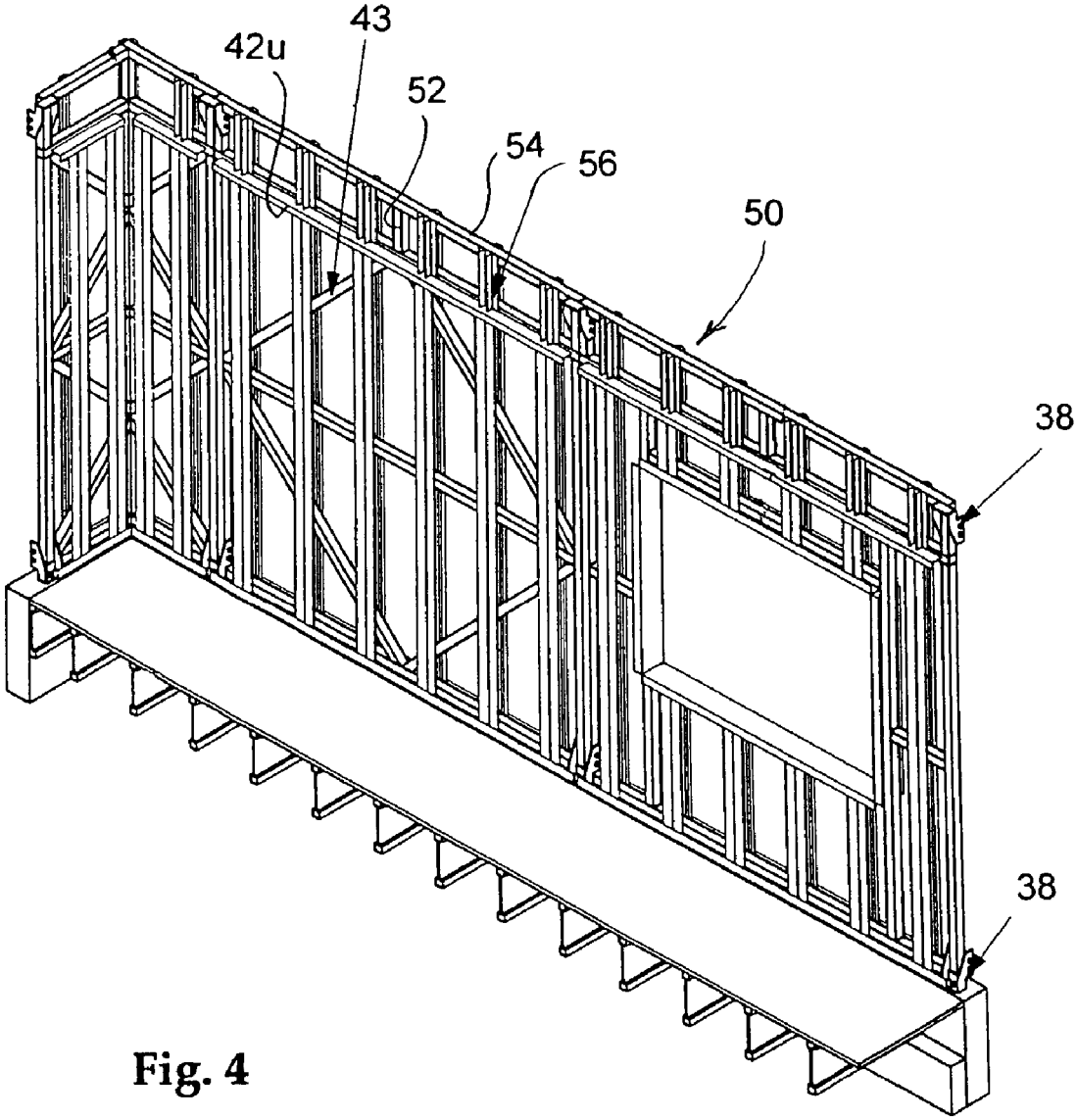
FIG. 4 is a sectional perspective of a portion of the building frame shown in FIG. 1 from the inside, with only the first story modules erected.

The top story of the end walls 22 and the side walls 26 are assembled from a plurality of top wall modules 44T, shown in FIG. 3, which are fabricated off site and trucked to the building site where they are bolted together as the top story of the building frame, shown in FIG. 1. The lower story of the end walls and sides walls are likewise assembled from a plurality of lower story wall modules 44L as shown in FIG. 4. The modules 44 are made in a welding shop from lengths of rectangular metal tubing, welded together at precisely 90° corners so that the assembled building frame is perfectly true and square when bolted together. The tubing is preferably commercially available 2"×2" square steel tubing having a wall thickness of 14 gauge, or 0.083", ASTM-A-500 with a yield strength of about 50 KSI and a tensile strength of about 55 KSI. Naturally, other materials could be used, but this material is preferred because it is widely available from many sources at low cost and in various wall thicknesses and dimensions for different strength requirements. The gauge is selected based on the strength requirements of the building frame and will normally be within the range of 7-16 gauge.

The modules are preferably welded together on a welding jig that holds the lengths of tubing at the desired 90° within about 2°, or preferably with about 1° tolerance. Care should be taken to tack weld the entire module before completely welding the junctions to avoid heat distortion of the assembly. TIG welding has been found to produce clean welds that do not require de-slagging and also minimize heat input into the junction. If enough welding jigs are not available for the desired production rate, the first module may be made on the welding jig and the other identical modules may be made on top of the first as a pattern.

The preferred standard wall modules 44, are exactly eight feet square, although the dimensions can conveniently be varied for different house designs if desired. The modules may be dimensioned to use standard interior wall board, such as that commonly sold in 4'×8' panels, so the interior may be finished without extensive cutting of the wall board. The top story wall module 44T shown in FIG. 3 includes two upright end members 40 and three longitudinal or girt members 42*u*, 42*m* and 42*b* welded between and spanning the end members 40. The upper girt member 42*u* is welded atop the ends of the two upright end members 40; the lower girt member 42*b* is welded flush with the bottom of the end members 40; the middle girt member 42*m* is welded between the upright end members 40 intermediate the upper and bottom girt members 42*u* and 42*b*, all at 90° corners.

As shown in detail in FIG. 3, an internal diamond shear brace is provided, having a 45° brace 43 welded to an upright end member 40 and the upper or bottom girt members 42*u* or 42*b*, across each corner. The internal placement of the diagonal braces 43, within the frame defined by the two upright end members 40 and the upper and bottom girt members 42*u* and 42*b*, ensures that light gauge elements, to be described below, can be attached to the inside and outside faces of the frame module 44 without special cutting or other costly operations. A third upright member 41 may be welded midway between the two upright end members 40 at the apex of the upper and lower diagonal braces 43 for additional vertical load bearing capacity if the building design requires the additional strength. The diamond shear module shown in FIG. 3 is used in the peripheral wall 20 in all modules that do not have a window or door opening to provide strength and stiffness in the plane of the wall section for resistance against deflection toward a parallelogram shape under wind loads or lateral shaking during an earthquake. Because this invention can be used in buildings as high as six stories, shear bracing is added for resistance to shear distortion as well as flexural distortion due to bending as a cantilever, so this strengthening minimizes not only threats to the safety of the occupants but also to the serviceability of the building after the windstorm or earthquake.

Two upstanding stub members 45, made of 4" lengths of the same 2"×2" steel tubing, are welded to the upper girt member 42*u* of the wall modules 44, and an eve strut 46 is welded between them about 2" above and parallel to the upper girt member 42*u*. The stub members are each off-set from the outer edge of the end members 40 by about 1", leaving a pocket 48, shown in FIGS. 1 and 5, between adjacent stub members 45 on adjacent wall modules 44 for receiving end portions of the trusses 28 and 30, as will be described in more detail below. The eve strut 46 stiffens the connection of the trusses 30 to the wall modules 44T in the pocket 48 and allows shear stresses exerted by the trusses on the stub members 45 to flow through the modules 44 from one side to the other.

The pocket 48 may be made deeper by using longer stub members 45, for example, by using 6" long stub members 45 instead of the 4" long ones. The longer stubs 45 raise the eve strut 46 to about the height of the roof sheathing, allowing the sheathing to be attached directly into the eve strut. Attachment of the roof sheathing to the eve strut 46 as shown in FIG. 1 adds to the diaphragm shear strength of the roof system.

To facilitate attachment of the roof sheathing 34 to the eve strut 46, the eve strut 46 is attached to the stubs 45 at an angle canted to correspond to the angle that the upper chord of the roof trusses lies. The depth of the pocket 48 is selected to allow the under surface of the eve strut to lie flush with the top surface of the top chord of the roof trusses, so the eve strut lies in the same plane as the purlins 32 attached to the trusses 28. Attachment of the roof sheathing to the eve struts 46 by self-drilling/tapping screws or the like is then the same as attaching the sheathing to the purlins 32. The attachment of the roof sheathing 34 directly to the eve struts 46 also increases the shear coupling between the roof and the building walls.

For buildings that do not have a hip roof, the wall modules for the end wall are identical to the side wall modules 36 except that the stub members 45 and the eve strut 46 are not used, so the upper girt member 42*u* is the topmost structural member on the end wall modules. This enables the lower chord of the end trusses to lie directly atop and be fastened to the upper girt members 42*u* of the end walls.

Figure 5:
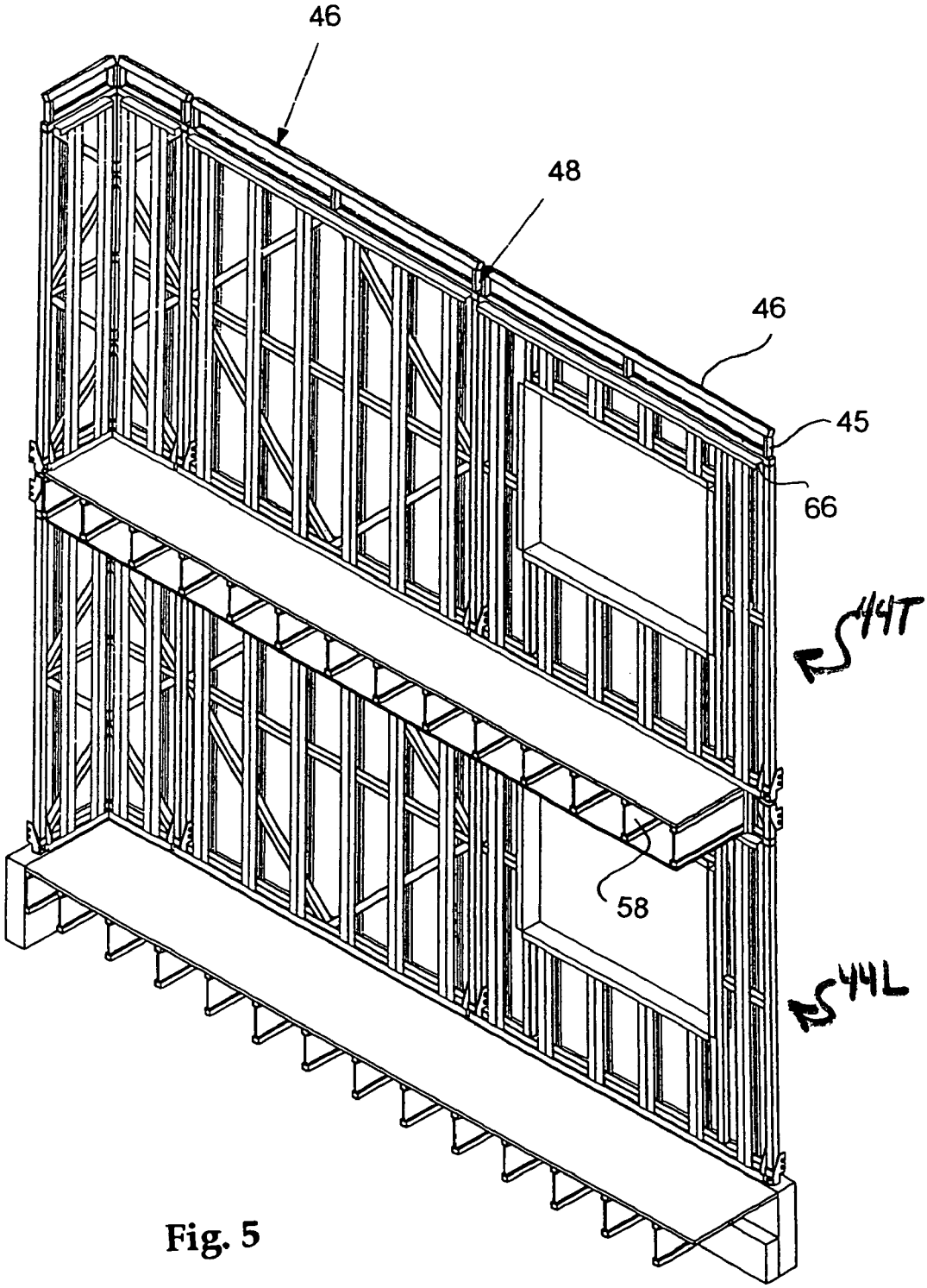
FIG. 5 is a sectional perspective of a portion of the building frame shown in FIG. 1 from the inside, with the first and second story modules erected.
Figure 6:
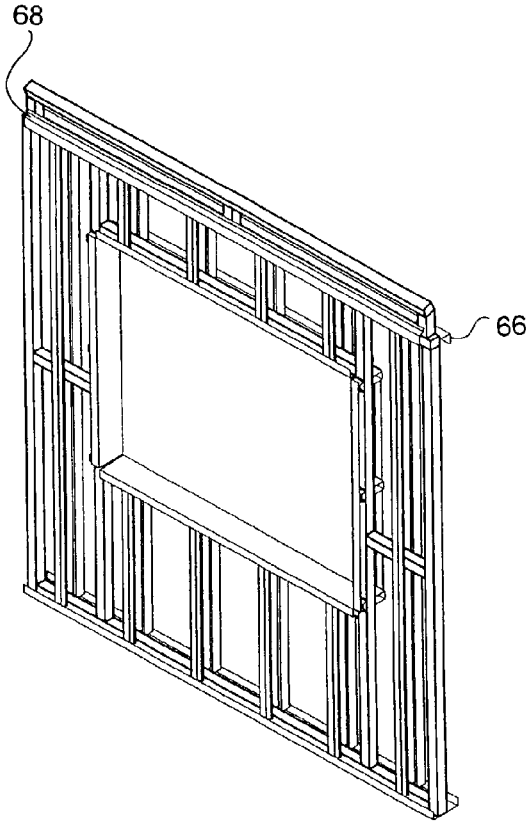
FIGS. 6 and 7 are perspective views of the outside and inside, respectively, of a window wall frame module used in the building frame shown in FIG. 1.
Figure 7:
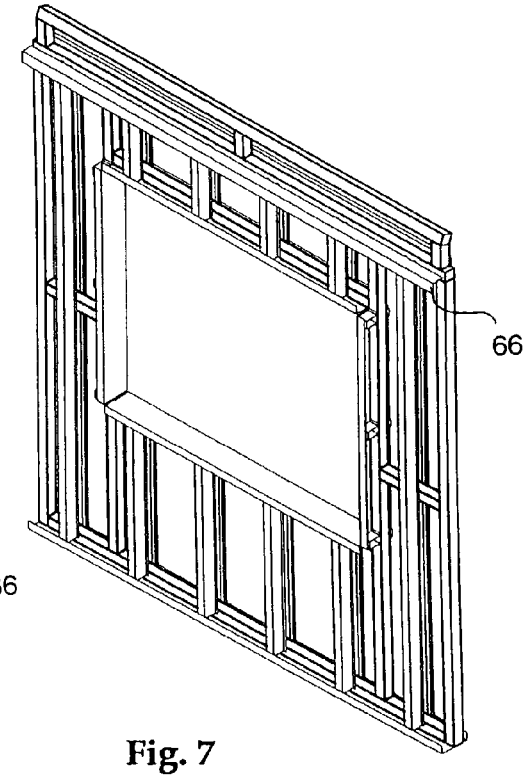
Figure 8:
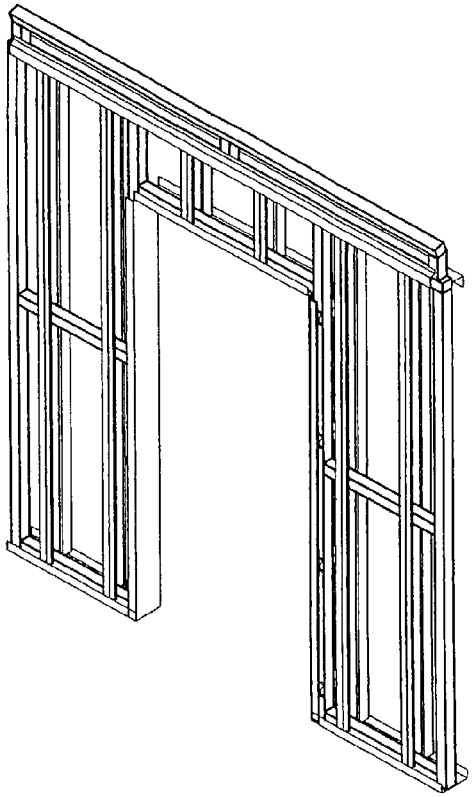
FIGS. 8 and 9 are perspective views of a door wall frame module for a building frame in accordance with this invention.
Figure 9:
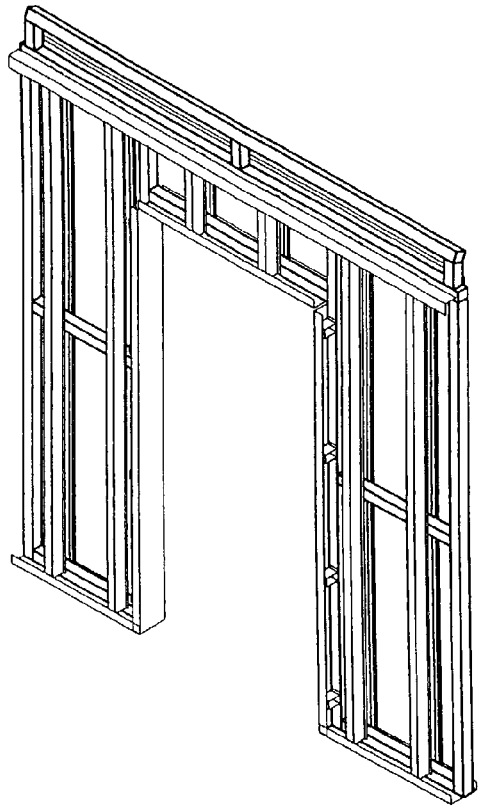

The lower story wall modules 44L shown in FIGS. 1 and 4 use the same basic welded tubing design described above in conjunction with FIGS. 3 and 6-9, but instead of the eve strut and truss pocket arrangement atop the upper girt member 42*u*, a wall extension 50 is welded for attachment of the second and higher story floor joists 52, as shown in FIGS. 2, 4 and 5. The wall extension 50 includes several vertical risers 52 welded atop the upper girt member 42*u*, and a top tube 54 welded to the top of the vertical risers 52. A series of joist hangers 56 is welded between the top tube 54 and the upper girt member 42*u* for supporting floor joists 58, as shown in FIG. 5. The hard attachment of the joists 58 between opposite walls of the building frame stiffens the frame against "oil can" diaphragm flexing of the side and end walls of the building frame.

Typical door and window wall modules, shown in FIGS. 6-9, do not normally include the diagonal shear bracing shown in the wall panel shown in FIG. 3 because the assembled wall frame with one or more diamond shear bracing modules as shown in FIG. 3 provides the shear stiffness for the entire wall.

Light gauge elements are welded to the frame modules 44 for attachment of exterior siding and interior finishing such as wallboard, paneling or the like. The light gauge elements include inside studs 60, exterior furring or stringers 62, bottom track 64, and interior top angle 66 and, for the top story modules 44T, exterior top angle 68. The inside studs 60 and the inside flange 61*i* of the bottom track 64 provide light gauge metal supports to which the interior wallboard can be attached by wallboard screws or the like. The ceiling wallboard and the top of the wall wallboard are attached to the interior top angle 66. The exterior furring 62 and the exterior flange 61*e* of the bottom track 64 provides attachment surfaces for attachment of exterior siding to the modules 44. On the top story module 44T, the exterior siding is attached at the top to the flange of the exterior top angle 68. The angle surface of the exterior top angle 68 provides an attachment surface for the soffit. The interior sheet metal elements are typically about 22 gauge, on the order of 0.034". The exterior sheet metal elements are typically about 20 gauge, on the order of 0.040". These gauges provide the desired stiffness and ease of welding to the tubing of the frame modules while allowing ready penetration by drilling screws during attachment of the interior wallboard and exterior siding.

Figure 10:
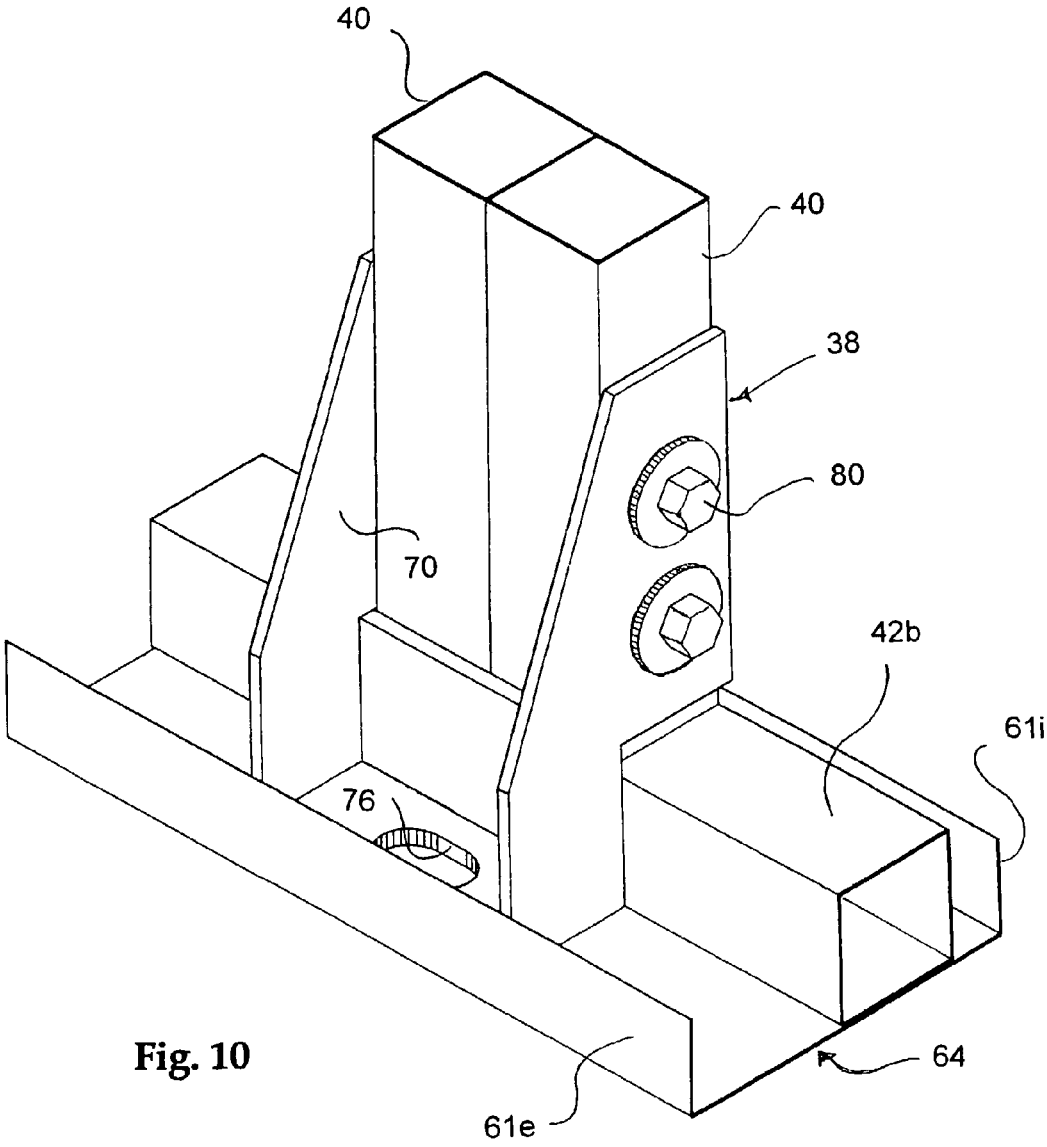
FIG. 10 is a perspective view of an anchor bracket holding the base of two adjacent wall modules in accordance with this invention.
Figure 11:
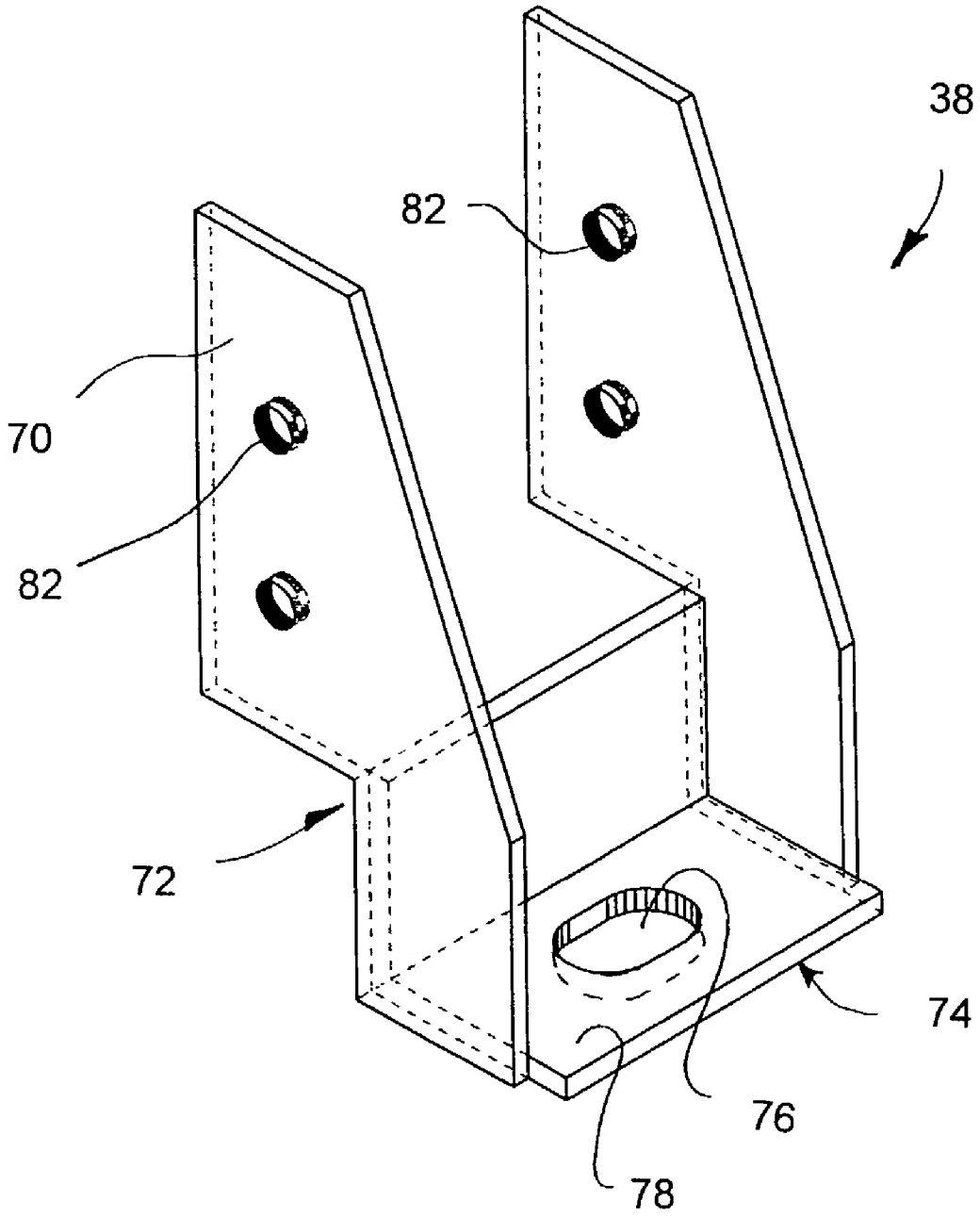
FIG. 11 is a perspective view of the anchor bracket shown in FIG. 10.

The anchor brackets 38, also called "connectors" and "hold-down devices" herein, by which the wall modules 44 are fastened to the building foundation 36 are shown in detail in FIGS. 10 and 11. Each anchor bracket 38 includes two side plates 70 having a square cut-out 72 at the bottom outside corner. The two side plates 70 are welded to opposite ends of a short length of angle iron 74 having a round or elongated hole 76 in the horizontal leg of the angle iron 74. The square cut-outs 72 form a step that allows the bracket to sit on the bottom track 64 adjacent the bottom girt member 42*b* with the two side plates bracketing adjacent upright members 40 of adjacent modules 44. A pair of bolts 80 extends through two holes 82 in each of the side plates 70 and corresponding holes in the adjacent upright members 40 of the adjacent modules 44 to secure the modules 44 together. An anchor bolt extends from the foundation through a hole in the bottom track 64 and through the hole 76, and a nut secures the anchor bracket to the anchor bolt and the foundation 36.

Figure 12:
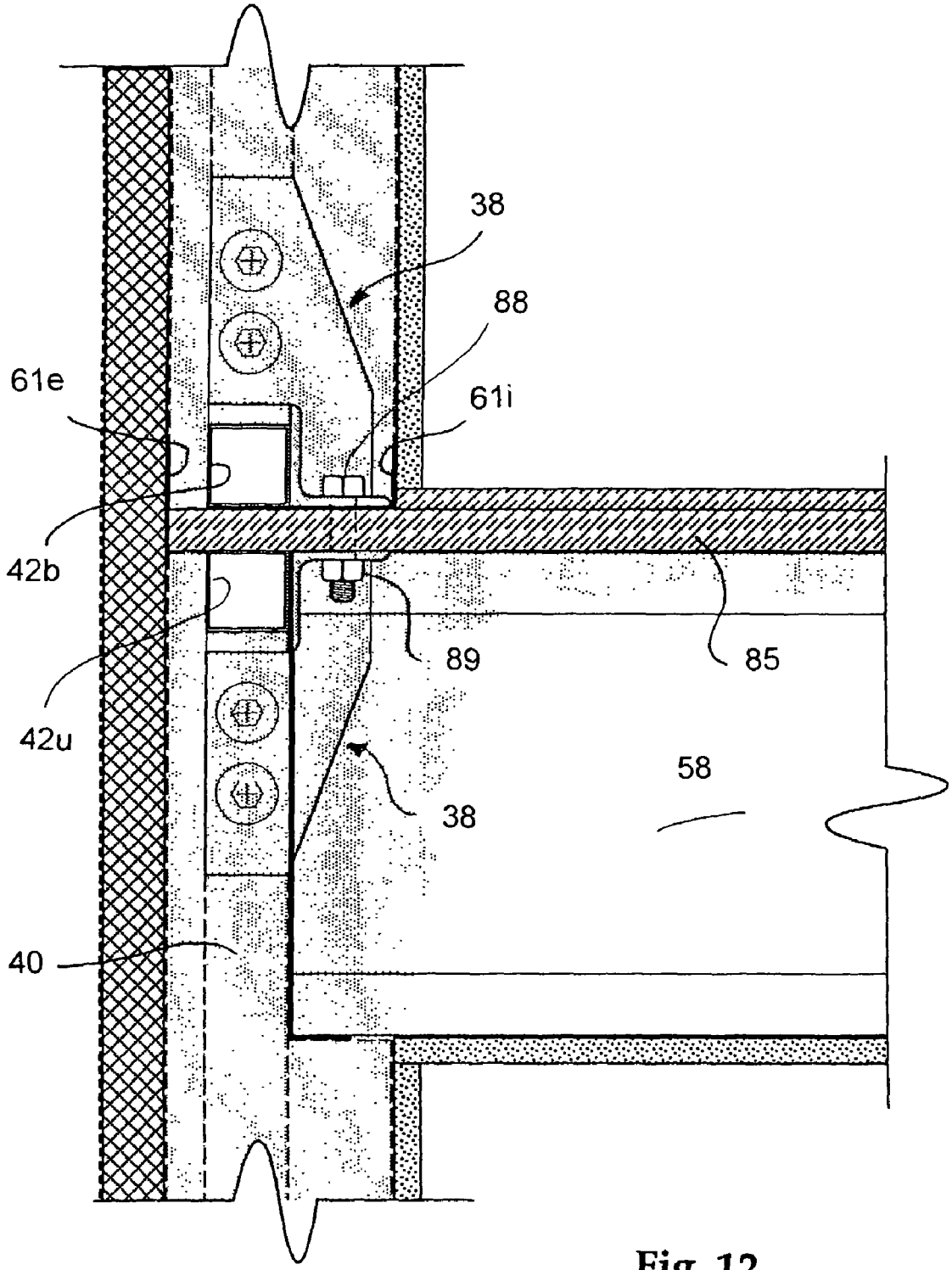
FIG. 12 is a sectional elevation of a second story joist and bottom-to-bottom anchor bracket arrangement in accordance with this invention.

The anchor brackets 38 are also used in a bottom-to-bottom arrangement, shown in FIG. 12, to secure vertically adjacent wall modules 44 together through the base floor deck 85 of the floor between the two wall modules 44. A bolt 88 extends through the holes 76 in the two anchor brackets 38 to clamp the base floor deck between the upper and lower wall modules 44

Figure 13:
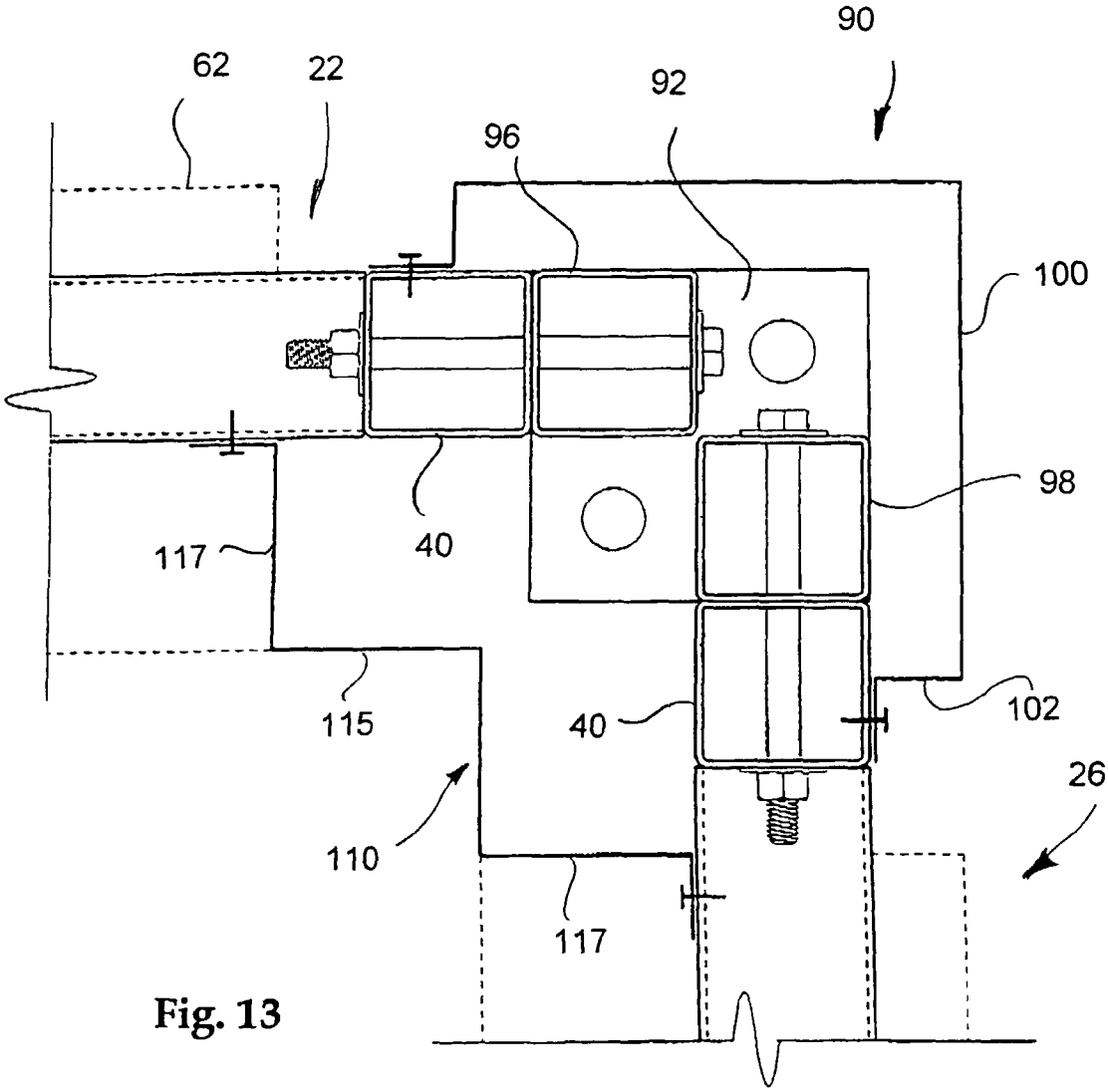
FIG. 13 is a plan view of structural corner connection for a building frame in accordance with this invention.

The corners at the junction of the end wall frames 22 and the side wall frames 26 are formed by a corner structure 90, shown in FIG. 13. The corner structure 90 includes a base plate 92 and a top plate 94 (not shown), and two vertical tubes 96 and 98 arranged edge-to-edge and welded in that position to the top and bottom plates 92 and 94. The adjacent edges of the vertical tubes 96 and 98 are stitch-welded along their length. The adjacent ends of the adjacent end and side wall frames 22 and 26 are attached to the tubes 96 and 98, respectively to provide a strong rigid corner structure.

A flanged right-angle exterior light gauge element 100 is attached around the outside of the corner structure 90 to provide an attachment structure for the exterior siding at the corner. The flanges 102 provide a stand-off for the attachment surface of the element 100 equal to the stand-off of the exterior light gauge furring 62, so the exterior siding lies perfectly flat along the outside of the building. An interior W-shaped light gauge sheet metal element 110 attaches to the inside surfaces of the adjacent modules of the adjacent end and side wall frames 22 and 26. Attachment surfaces 115 for attachment of the interior wallboard are off-set from the surfaces of the tubing by stand-off portions 117 that are the same width as the interior studs 60, so the wallboard is supported perfectly flat at its junction at the corner.

Figure 14:
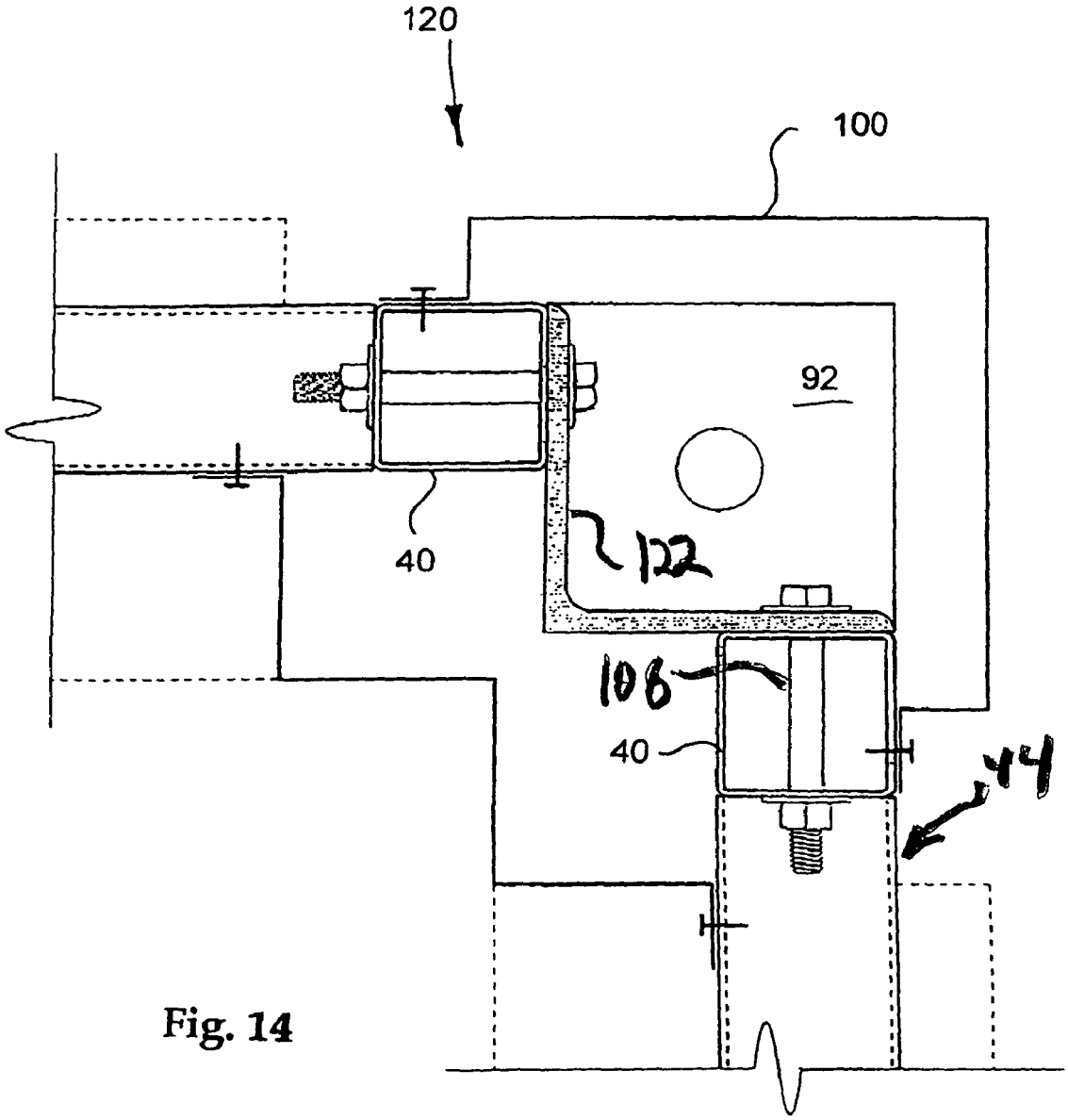
FIG. 14 is a plan view of an alternative structural corner connection for a building frame in accordance with this invention.

Another version of the corner structure is shown in FIG. 14. In this form, the corner structure 120 has a length of heavy angle iron 122 welded between the top and bottom plates 92 and 94 instead of the two edge-to-edge tubes 96 and 98 as shown in FIG. 13. In all other respects, the corner structures 90 and 120 are structurally identical.

The wall modules 44 can be made different sizes for different building designs, but it is most economical to use the same wall modules and adjust the wall lengths by adding short end modules 125 to provide the added increment of wall length to satisfy the exact wall length desired. The short wall end modules 125 shown in FIGS. 1 and 2 are structurally alike the standard wall modules 44 except, of course, they are shorter. The diagonal bracing 43 is preferably designed to lie aligned with and at the same angle as the shear bracing 43 in the adjacent module to provide continuous shear bracing to the corner, but shear bracing will not always be needed in the short end modules 125.

After the wall modules 44 and trusses 28 and 30 have been fabricated in the shop and the foundation has cured, the wall modules and trusses are trucked to the building site and unloaded around the foundation at about the positions they will occupy on the foundation. The lower story modules 44L can be tipped up with a small crew and bolted together with bolts 80 extending through aligned holes in the upright end members 40 at the top and at the bottom adjacent the lower longitudinal member 42*b* through the side plates 70 of the anchor bracket, with an additional bolt 80 at about the mid-level height of the end members 40. The corner modules are first fastened together to the corner structure 90 or 120, and then and the anchor brackets are fastened to anchor bolts in the foundation. The intermediate modules are then added and secured with bolts. When all the wall modules have been erected and connected together, the bolts 106 are tightened.

When all the lower story wall modules 44L have been bolted together to complete the peripheral wall 20 for the first story, second story floor joists 58 are lifted into place and bolted to the joist hangers 56. Base floor deck 85 is laid on and attached to the joists 58 out to the outer periphery of the wall frame 20. Now the second story wall modules 44T are lifted into place and attached together in the same manner as the ground story wall modules 44L were attached. In the case of the building shown in FIG. 1, the second story frame modules have the joist pockets 48 and eve struts since that will be the top story. If the building were a three story or higher building, additional stories of modules 44L would be installed.

The anchor brackets 38 are attached to the adjacent upright frame members 40 of adjacent frame modules 44*u* and the vertically adjacent upright frame members 40 of adjacent frame modules 44L, and the bolt 88 is inserted through the aligned holes 76 in the anchor bracket and a hole drilled in the base floor deck 85. The bolts 88 of all the installed anchor brackets 38 are tightened by torquing the nuts 89 on the bolts 88 when the modules have all been erected and bolted together.

After the wall frame is erected, the trusses 28 are lifted onto the top of the peripheral wall 20 for attachment thereto. The center trusses 28 are attached first by laying the opposite ends of the bottom chord in the chosen truss pocket 48. The other center trusses 28 are likewise fitted into the pockets 48 between the upstanding stub members between adjacent side wall modules 44T. A bolt is inserted through a hole that was pre-drilled in the shop through the upstanding stub members 45 and preferably also through the lower chord of the trusses 28, and the bolt is tightened to secure the trusses to the peripheral wall 20. Alternatively, the upright stub members 45 could be predrilled and the truss lower chord 96 back drilled when it is in place to avoid the possibility of slight misalignment of the holes when the parts come together. The bolting of the trusses into the pockets 48 through the upright stub members 45 secures the roof to the peripheral wall 20 and, together with the anchoring of the peripheral wall 20 to the foundation, anchors the roof to the foundation against displacement due to wind loads or differential movement of the foundation and the building during an earthquake.

Figure 15:
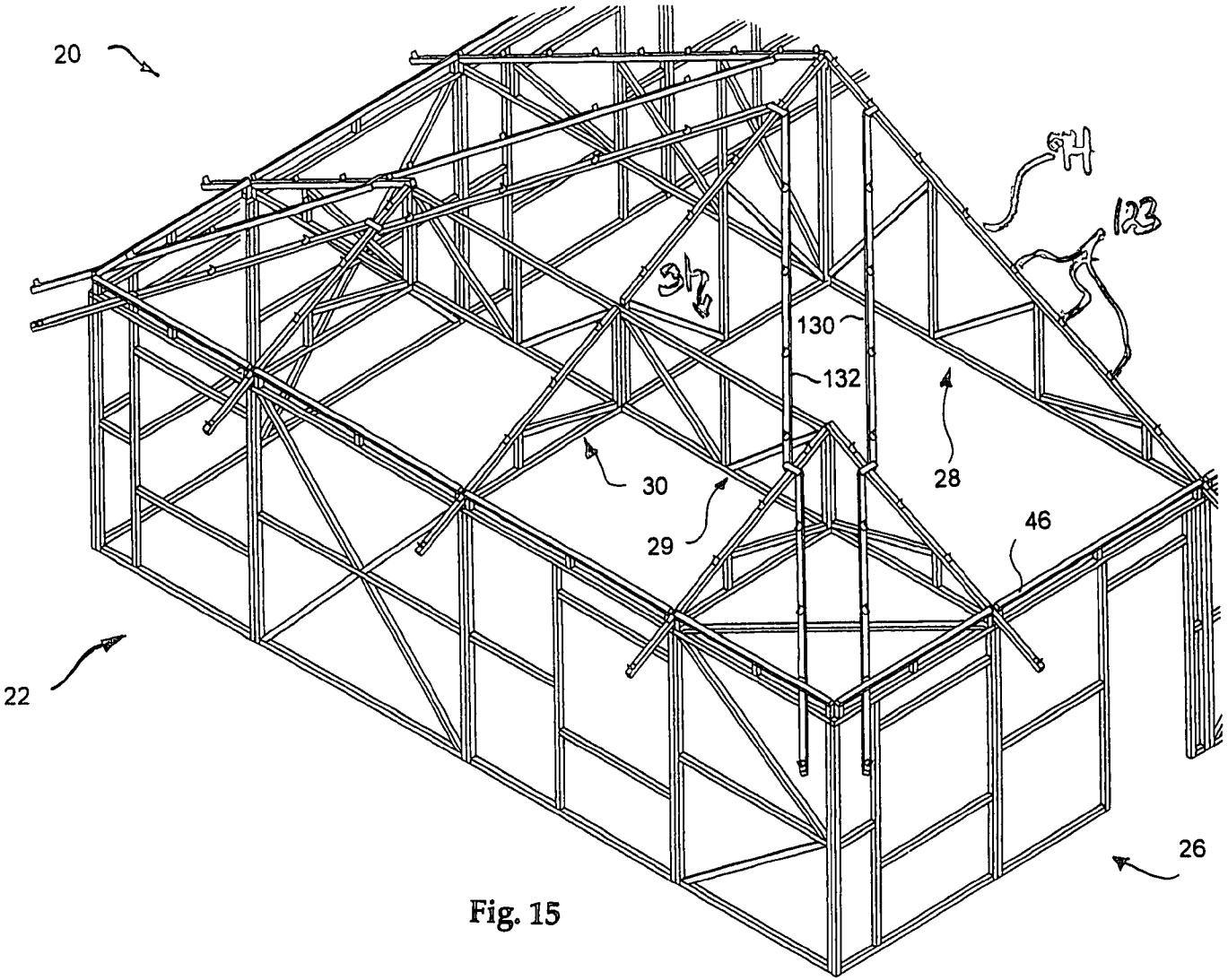
FIG. 15 is a perspective view of a portion of a building frame in accordance with this invention showing the details of the hip roof supporting structure.

The hip roof trusses, shown in FIG. 15, are designed to support a roof lying at an angle to the crest of the "main" roof supported by the lateral trusses 28. The hip roof supports roof purlins that extend out to the junction with the main roof along a hip ridge. A series of jack trusses 30 lying perpendicular to the planes of the main trusses 28 are supported at one end on the end wall frame 22, and are supported at their other ends at intermediate positions along a lateral girder truss 29. The center jack truss 30 has an extension 31 that spans the distance between the lateral girder truss-29 and the last main lateral truss 28 adjacent the junction with the hip roof.

Two hip beams 130 and 132 are provided for supporting ends of the main roof purlins and the hip roof purlins at the hip ridge. Each hip beam 130 and 132 lies generally adjacent and parallel to the hip ridge. The hip beam 130 has an upper surface lying in the plane of the main roof and the hip roof beam 132 has an upper surface lying in the hip roof plane. The hip beams are each attached adjacent one end thereof to the underside of the eve strut 46, and are attached adjacent the other end thereof to a truss.

The hip beam 132 is made of two pieces, each supported at adjacent inner ends thereof on the outermost jack truss by way of attachment bars spanning top and bottom surfaces of an upper chord of the jack truss 30 at the inner ends of the hip beam pieces. In this way, the hip beam is supported at the same angle as the jack truss for flush attachment of the purlins to the hip beams and the jack trusses. The hip beam 130 also has two parts, each having an inner end. The inner ends of the two parts are supported on the girder truss with upper surfaces of the hip beam 130 flush with upper surfaces of the girder truss so the purlins supported at their ends by the hip beam 130 lie in the plane of the main roof.

Figure 16:
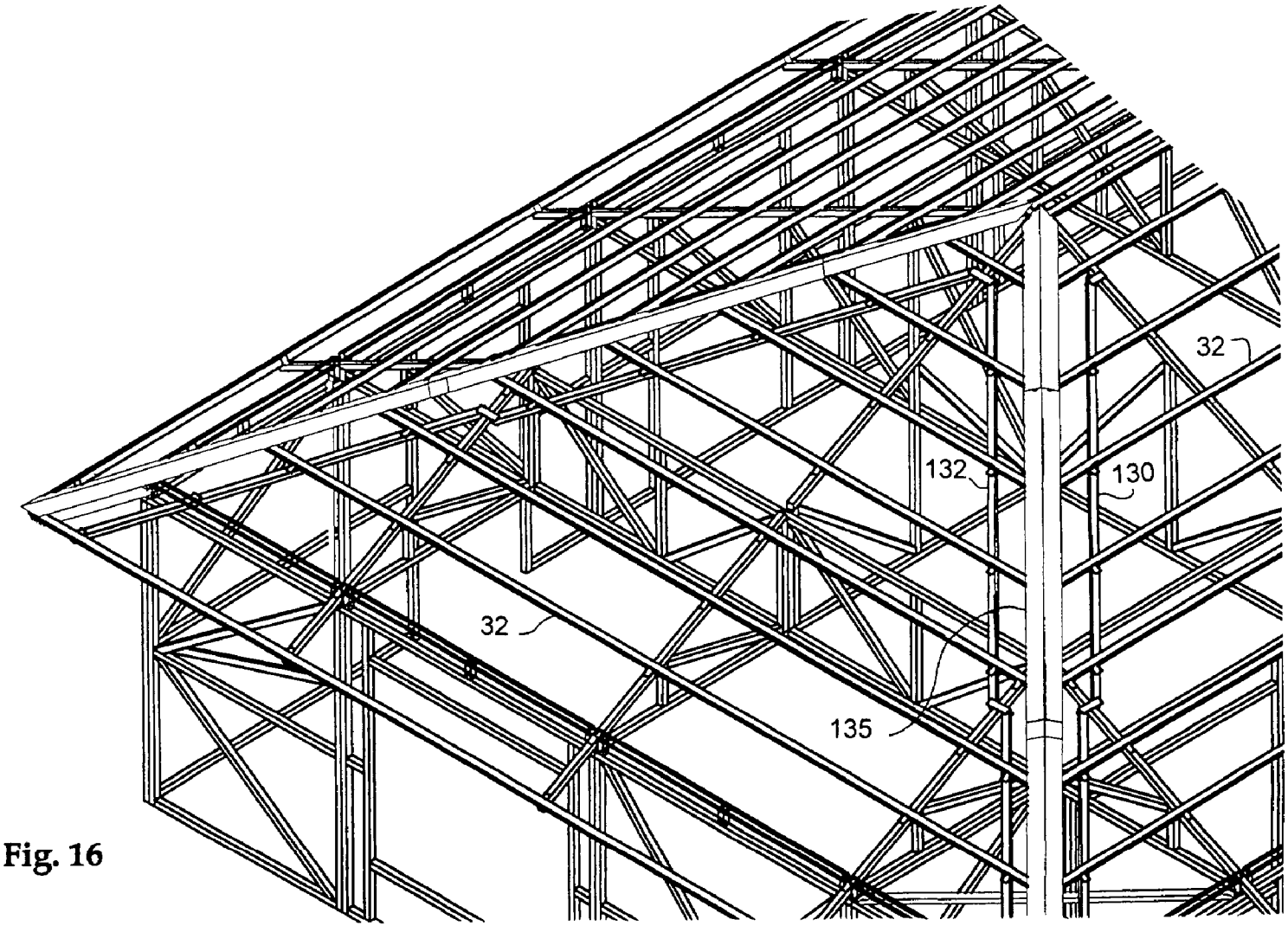
FIG. 16 is a perspective view of the structure shown in FIG. 15, with the purlins and ridge cap attached.
Figure 17:
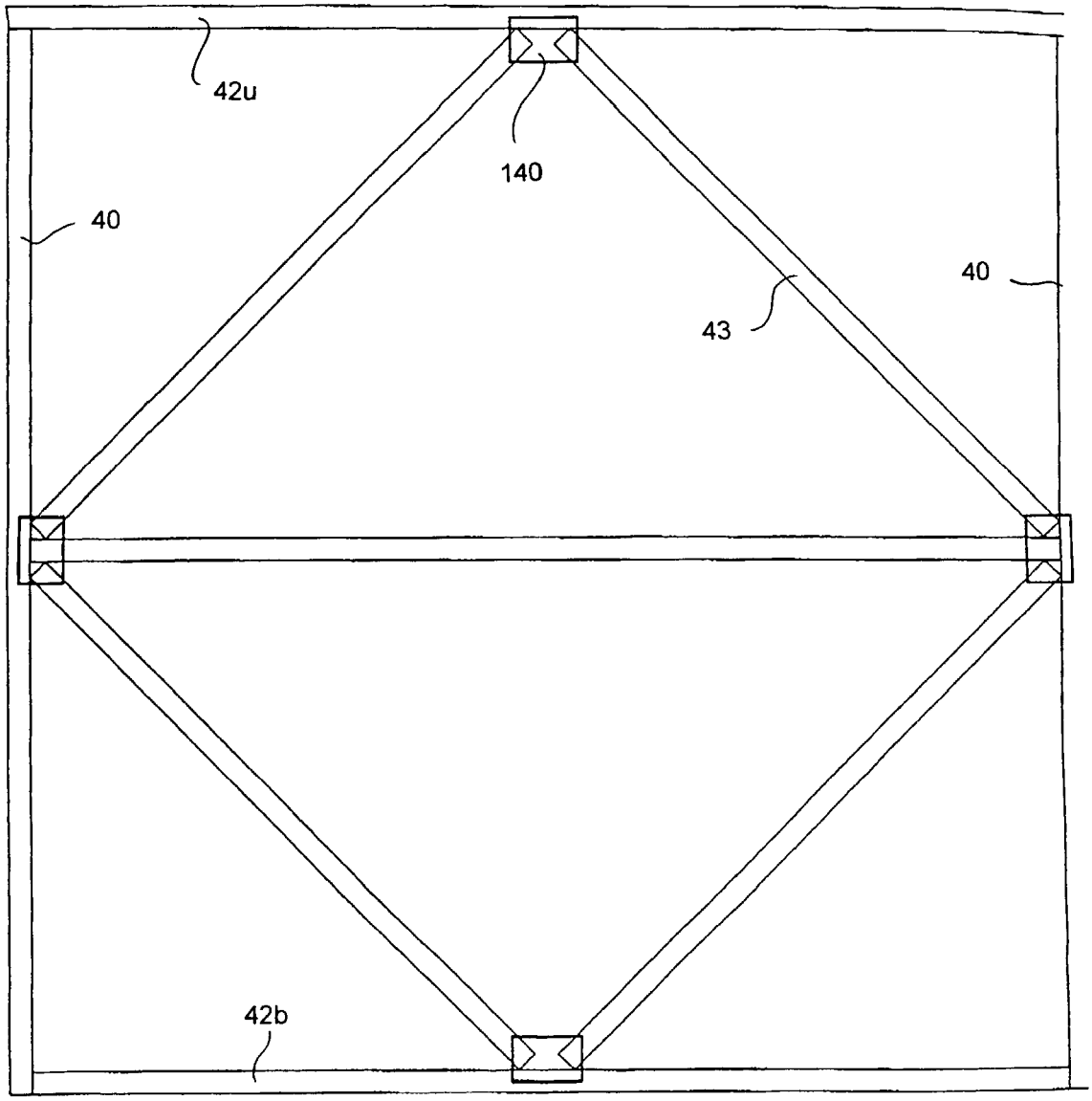
FIG. 17 is a schematic elevation of a portion of a modification of the frame module shown in FIG. 3, showing how welding plates can be used to reduce cutting and welding time.

After all the trusses 28 and 30 have been bolted into the pockets 48, the purlins 32 are inserted between and fastened to pairs of L-shaped brackets 123 prewelded onto the upper chord 94 of the trusses, and are fastened thereto by nuts and bolts or by self-drilling/tapping screws through each bracket. The purlins 32 lie atop the trusses 30 and connect them together. A sheet metal ridge angle piece 135 is attached to the adjacent ends of the purlins at the hip ridge, as shown in FIG. 16. Roof sheathing is laid over and screwed to the purlins, as shown in FIG. 1, and the roof is sealed and shingled in the usual manner.

A foaming insulating material is applied against the inside surface of the exterior siding and is allowed to expand around the wall frame, sealing and insulating the wall. After setting, the foam is sawed off flush with the surface of the interior studs 60 providing sound dampening as well as thermal insulation. The spacing of the wallboard and the extersiding away from the structural frame provides excellent thermal insulation. The wall, with a double layer of wallboard on both sides, was tested in accordance with the Standard Fire Tests of Building Construction and Materials, ANSI/UL263. After three and one half hours the test was terminated with the wall still intact.

The invention thus enables the low cost construction of a house with design capabilities of meeting the design needs of multiple requirements without major redesign. In areas where heavy snow loads can be expected, the pitch angle of the trusses can be increased to any desired angle to increase the load bearing strength and the snow shedding capability of the roof. In earthquake prone areas, the diagonal shear panels give redundant load sharing capability. The roofing material may be selected for minimum weight to minimize the inertial forces so the house moves more like a rigid unit rather than a flexible vertical cantilever. This will minimize the damage to the building caused by differential movement of the foundation and the roof so that the building will remain serviceable after the earthquake. The metal frame building is inherently immune to attacks by termites and carpenter ants as well as mold and mildew, and is inherently resistant to fire damage.

Obviously, numerous modifications and variations of the preferred embodiment described above are possible and will become apparent to those skilled in the art in light of this specification. For example, the welding of the diagonal braces 43 can be by way of weld plates 140 instead of cutting the ends of the tubes 43 to fit flush against the inside surface of the frame members 40, 42*u* and 42*b*, thereby saving cutting and welding time and producing a product that is as good or better. Many functions and advantages are described for the preferred embodiment, but in some uses of the invention, not all of these functions and advantages would be needed. Therefore, we contemplate the use of the invention using fewer than the complete set of noted functions and advantages. Moreover, several species and embodiments of the invention are disclosed herein, but not all are specifically claimed, although all are covered by generic claims. Nevertheless, it is our intention that each and every one of these species and embodiments, and the equivalents thereof, be encompassed and protected within the scope of the following claims, and no dedication to the public is intended by virtue of the lack of claims specific to any individual species. Accordingly, we expressly intend that all these embodiments, species, modifications and variations, and the equivalents thereof, are to be considered within the spirit and scope of the invention as defined in the following claims, Wherein we claim:

1. A device for securing portions of a metal building frame in place, comprising:

a hold-down device for cooperating with an anchor in a building foundation to secure frame modules of a metal building frame together and to said foundation, said hold-down device including a base plate oriented to lie flat against a horizontal surface of said foundation, said base plate having an opening for receiving said anchor and engaged by a nut threaded onto said anchor for securing said hold-down to said foundation; and a pair of spaced opposed side plates spaced apart to straddle adjacent uprights of said frame modules;

said side plates each having at least one bolt hole aligned with a corresponding bolt hole in the opposed side plate for receiving bolts through said bolt holes and through a hole drilled in frame modules adapted to be straddled by said side plates, and said side plates also each having a cut-out at a bottom outside corner to allow said side plates to lie over a base tube of a metal frame module of a metal building frame to hold said base tube down.

2. A metal frame for a wind-resistant building having at least two stories, comprising:

a peripheral first floor wall frame having side wall frames made of side wall frame modules bolted together along adjacent edges and end wall frames made of end wall frame modules bolted together along adjacent edges, said side and end wall frame modules constructed of rectangular steel tubing welded together, said end wall frames each having two ends, each bolted to corresponding ends of said side walls to form a peripheral wall of said building;

hold-downs for securing said first floor wall frame to a building foundation;

joist supports attached to upper portions of said peripheral first story wall frame for supporting second story floor joists spanning said peripheral first floor wall frame, said second story floor joists supporting a second story floor;

a peripheral second story wall frame sitting atop said second story floor, said peripheral second story wall frame having side wall frames made of side wall frame modules bolted together along adjacent edges and an end wall frame made of end wall, frame modules bolted together along adjacent edges, said side and end wall frame modules constructed of rectangular steel tubing welded together, said end wall frame having at least two ends, each bolted to corresponding ends of said side wall frames to form a second story peripheral wall frame of said building;

connectors for connecting upper portions of said peripheral first floor wall frame to lower portions of said peripheral second story wall frame;

said connectors each including two attachment devices, each attachment device having a base plate having an opening for receiving an attachment bolt, which provides a tensile force for holding said first and second story frames together, and engaged by a nut threaded onto said bolt for transferring tensile force in said bolt to said base plates; and a pair of spaced side plates spaced apart to straddle adjacent uprights of said frame modules, said attachment devices arranged in a bottom-to-bottom orientation on opposite sides of a second story floor and attached to upper portions of a first story frame and lower portions of a second story frame with said bolt extending through said floor and through base plates of said attachment devices for connecting 1st and 2nd story wall frames with said bolt in said plural-story building; said side plates each having a cut-out at a bottom outside corner to allow said side plates to lie over a base tube of a metal frame module of a metal building frame to hold said base tube down.

3. A metal frame for a building as defined in claim 2, further comprising:

said peripheral first floor wall frame includes a frame extension welded atop said first floor wall frame modules, said frame extension having a height at least as deep as said joists.

4. A metal frame for a building as defined in claim 2, wherein said hold-downs include:

two attachment devices, each having a base plate having an opening for receiving an attachment bolt, which provides a tensile force for holding said first and second story frame modules of first and second story building frames together, and engaged by a nut threaded onto said bolt for securing said attachment devices together, and a pair of spaced side plates spaced apart to straddle adjacent uprights of said frame modules, said attachment devices adapted to be arranged in a bottom-to-bottom orientation on opposite sides of a second story floor and attached to upper portions of a first story frame and lower portions of a second story frame with said bolt extending through said floor and through base plates of said attachment devices for securing first and second story frames together in said plural-story building.

5. A metal frame for a building as defined in claim 2, wherein:

said frame modules of said metal building frame include side wall frames made of side wall frame modules bolted together along adjacent edges, said side wall frame modules constructed of rectangular steel tubing welded together, at least one of said side wall frame modules having diagonal bracing;

said frame modules of said metal building frame also include end wall frames made of end wall frame modules bolted together along adjacent edges, said end wall frame modules constructed of rectangular steel tubing welded together, at least one of said end wall frame modules having diagonal bracing;

said end wall frames each having two ends, each connected to corresponding ends of said side walls to form a peripheral wall frame of said building.

6. A device as defined in claim 1 for securing portions of a metal building frame in place, further comprising:

an upright plate having opposite ends attached to said side plates and a bottom edge attached to said base plate.

7. A device as defined in claim 6 for securing portions of a metal building frame in place, wherein:

said upright plate and said base plate are made in one piece from a short length of angle iron welded at opposite ends to said two side plates.

* * * * *